United States Patent [19]

Stäb

[11] Patent Number: 4,995,858

[45] Date of Patent: Feb. 26, 1991

[54] DEVICE FOR HALTING SHEET PRODUCTS

[75] Inventor: Rudolf Stäb, Frankenthal, Fed. Rep. of Germany

[73] Assignee: Albert-Frankenthal AG, Frankenthal, Fed. Rep. of Germany

[21] Appl. No.: 469,315

[22] Filed: Jan. 24, 1990

[30] Foreign Application Priority Data

Feb. 4, 1989 [DE] Fed. Rep. of Germany ..... 3903381

[51] Int. Cl.[5] ..... B65H 9/04

[52] U.S. Cl. ..... 493/445; 198/463.4; 198/634; 271/245; 271/256

[58] Field of Search ..... 271/182, 190, 245, 246, 271/256, 258, 259; 493/444, 445; 198/836.2, 836.3, 464.2, 463.4, 634

[56] References Cited

U.S. PATENT DOCUMENTS

| | | | |
|---|---|---|---|
| 1,883,471 | 10/1932 | Barrett | 271/245 |
| 3,944,211 | 3/1976 | Rasmussen et al. | 271/245 X |
| 4,189,271 | 2/1980 | Hasegawa | 271/245 X |
| 4,289,229 | 9/1981 | Keller | 198/463.4 X |
| 4,557,473 | 12/1985 | Pecak | 271/245 X |
| 4,746,004 | 5/1988 | Hess et al. | 271/245 X |
| 4,798,040 | 1/1989 | Haas et al. | 198/464.4 X |
| 4,877,232 | 10/1989 | Nakanishi | 271/245 X |

FOREIGN PATENT DOCUMENTS

| | | | |
|---|---|---|---|
| 48611 | 11/1986 | Japan | 271/245 |
| 48701 | 1/1987 | Japan | 271/245 |

*Primary Examiner*—Joseph E. Valenza
*Assistant Examiner*—Carol Lynn Druzbick
*Attorney, Agent, or Firm*—Harrison & Egbert

[57] ABSTRACT

A device for halting sheet products transported by a conveyor belt, comprising an abutment having a conveyor belt passing through it and an adjustable braking device placed ahead of the abutment. By this arrangement it is possible to ensure a high degree of convenience of operation and of reliability if the impact of the products on the abutment is able to be sensed by means of a sensing device and the position of the braking device is able to be corrected in accordance with an output value produced by the sensing device.

9 Claims, 1 Drawing Sheet

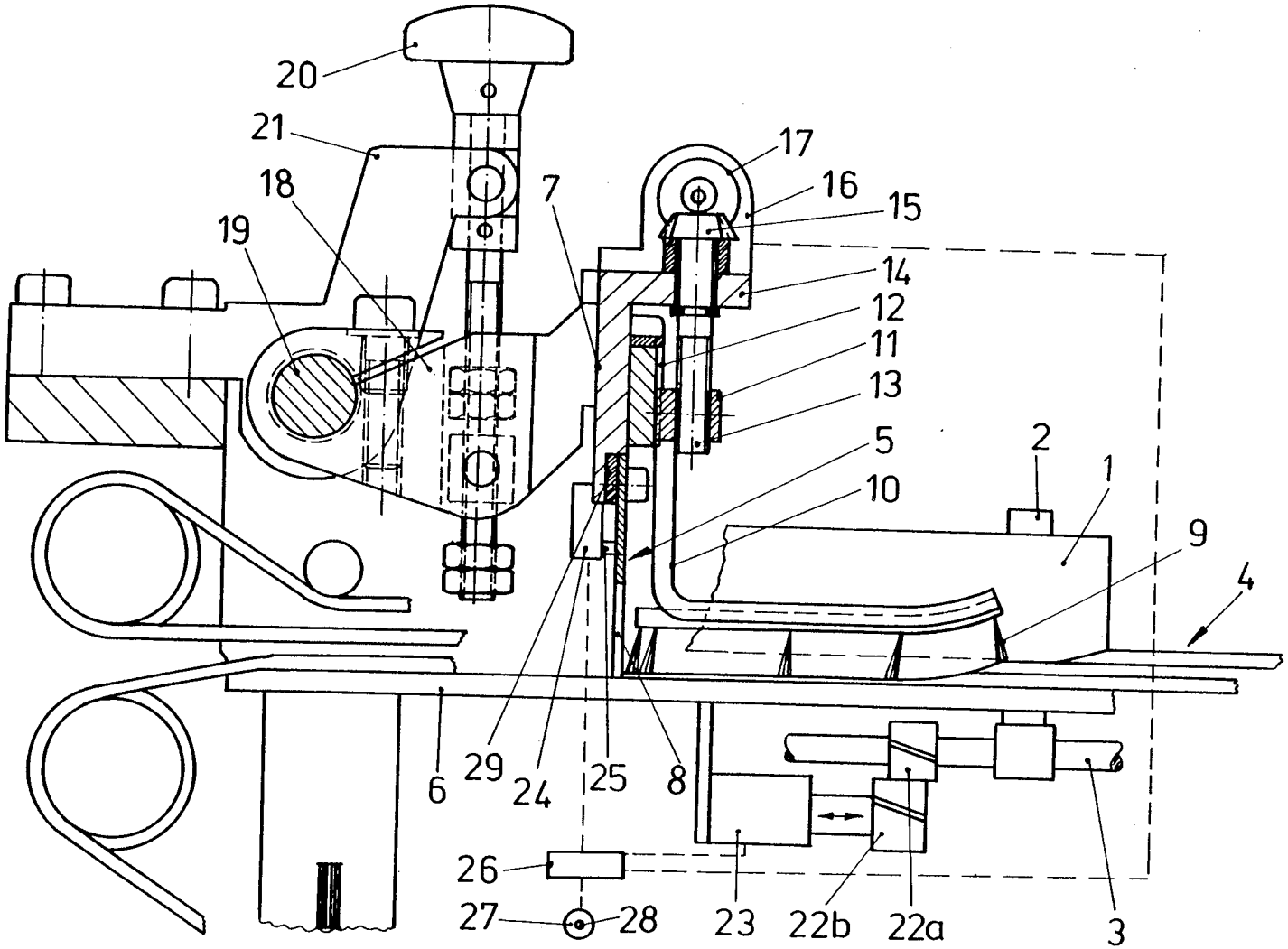
4
9
1
2
3
22a
22b
23
15
14
12
11
13
5
10
16
17
8
28
25
7
24
29
26
27
6
20
21
18
19

DEVICE FOR HALTING SHEET PRODUCTS

BACKGROUND OF THE INVENTION

The invention relates to a device for halting sheet products transported by a conveyor belt, comprising an abutment preferably having the conveyor belt passing through it and an adjustable braking means placed ahead of the abutment and preferably at least in the form of a brush fitting over a table and able to be raised and lowered in relation to the conveying plane of the conveyor belt.

In known arrangements of this type the braking means is permanently set in accordance with the speed of the conveyor belt. A disadvantage in this respect is that the momentum of the sheet products striking against the abutment is practically left out of consideration. A further point is that even intrinsically identical sheet products may behave completely differently if, for instance, the ink thereon is different in type or amount. These interfering factors have not been taken into account either so far. Furthermore, the braking elements are subject to a distinct wear rate this being a further complication. Thus it has been necessary to take these variables into account empirically and to reset the braking means from to time to time by hand. This however meant that much time and trouble had to be spent on checking and servicing the plant. One may thus say that this prior art plant is not sufficiently simple to operate and is prone to roughly handle the products.

SHORT SUMMARY OF THE INVENTION

Accordingly taking this prior art as a basis, one object of the present invention is that of providing such an improved device of the type noted initially that it is very simple to operate.

A further aim of the invention is to provide such a device which ensures a gentle handing of the products.

In order to achieve these or other objects appearing from the present specification, claims and drawing, the invention provides a device in which the abutment may be sensed by a sensing means responsive to the forces, or parameters derived therefrom, acting on the abutment when the said products strike, it, and the braking device is adapted to be reset in accordance with the value presented at the output of the sensing means.

These features lead to the advantage of a continuous, automatic resetting of the braking means, the momentum at impact, which is ascertained by the sensing means, of the sheet products on the abutment alone being decisive for the effective braking action. Thus interfering factors such as variations in the type and amount of printing ink or traces of silicone on the products or wear of the braking elements and/or of the belts of the conveyor belt system etc. are just as well taken into accounting an advantageous manner as the speed of the conveyor belt and the momentum of the products. This means that it is possible to keep up production over long periods of time without there being undesired damage to the products when they strike the abutment.

In accordance with an advantageous further development of the invention it is possible for the abutment to be a part which is able to give way resiliently and to be shifted out of its normal position by the impacting products. The sensing means may in this respect simply be in the form of a position detector. This results in having a mechanical pickup means, which makes the system very sturdy in construction.

As part of a still further development of the invention it is possible for the abutment to take the form of a spring which is preferably embodied as a piece of sheet metal clamped at one end at an edge parallel to the table, or it may be supported by at least one spring. In this case the sensing means only needs to comprise a sensing pin which engages the abutment and is able to be moved by it. These features therefore result in a particularly simple and sturdy design, which furthermore has the useful characteristic of being well adapted for incorporation in pre-existing plant.

Further expedient features and promising developments of the invention will be gathered from the claims.

In what follows a description will be given of only one possible embodiment of the invention with reference to the drawing, whose single FIGURE shows a chopper folder unit in partial section, which is fitted with a device in accordance with the invention.

DETAILED ACCOUNT OF WORKING EMBODIMENT OF THE INVENTION

A folder provided with a chopper folding unit generally makes possible the handling of sheet products which in addition to a first, longitudinal fold and a transverse fold are also provided with a second longitudinal fold, which is produced with the aid of the chopper folding unit. The same consists of a vertically reciprocating chopper 1 cooperating with folding rolls which are not shown in detail. The folding chopper 1 is mounted on a pivoting arm 2, which may be driven by means of a drive shaft S. The folding chopper 1 extends in parallelism to conveyor belt 4, which supplies sheet products respectively with one longitudinal fold and one transverse one to an abutment 5 arranged after the folding chopper 1. It is at this abutment 5 that the products are halted prior to the production of the third fold.

The abutment 5 consists of a sheet metal member which is mounted on a crosspiece 7 extending over the table 6 under the conveyor belt 4 and which has openings 8 for the belt elements of the conveyor belt 4, such belt elements being changed in direction downstream from the abutment 5. The table 6 naturally has an opening to receive the folding chopper 1 so that the sheet products may be pushed by means of the folding chopper 1 into the folding gap between the folding rolls located under the table 6. In order to gently handle and to prevent damage to the sheet products, which are halted at the abutment 5, and to prevent the sheet products from recoiling from the abutment after striking it, the invention provides a braking means to slow down the products before impact. In the illustrated working example of the invention this braking means comprises a brush 9 arranged over the table 6 and whose bristles stroke the sheet products moving on the conveyor belt between its upper and lower belt elements. Like the table 6 the brush 9 is so divided adjacent to the folding chopper 1 that there is a gap for the latter.

The brush 9 is arranged so that it may be moved upwards in order to set the frictional braking effect or force. For this purpose the brush 9 or, respectively, each part thereof, is mounted by means of brackets 10 on a carriage 11 which is able to be slid upwards and downwards. The guide 12 on which the carriage 11 is mounted is attached to the crosspiece 7. There is at least one set screw 13 extending vertically in relation to the plane of the table and cooperating with screw means on the carriage 11. This set screw 13 bears against the two sides of a further bracket 14 of the crosspiece to prevent relative axial motion between the screw and the bracket and it has its top end provided with a drive wheel 15. This setting wheel 15 is in mesh with a drive motor 16 also mounted on the bracket 14.

The crosspiece 7 bearing the abutment 5 and the brush 9 may be mounted so that it is fixed in relation to the frame of the folder. In the illustrated working example the crosspiece 7 is attached to a pivot arm 18, which is clamped on a support rod 19. The pivot arm 18 is engaged by a setting screw 20 carried on a bracket 21 fixed to the frame so that when the clamping effect is relieved the pivot may be reset by hand. This means that the desired basic setting of the abutment and of the brush 9 may be produced. Correction or adjustment of the position of the brush 9 during operation then takes place by operation of the motor 16.

A further possibility for slowing down the sheet products is one in which the folding chopper 1 is so far advanced within its cycle of motion that its lower edge comes into engagement with a sheet product (which may comprise one or more plies) between the belt elements of the conveyor belt even before the leading edge of the product has reached the abutment 5. For this purpose the drive shaft 3 is suitably twisted. In the illustrated working example the drive shaft 3 is for this purpose provided with a helically toothed pinion **22*a*, which meshes with a wheel 22*b*, also having helical teeth, able to be set in the axial direction thanks to the provision of a setting means 23** in the form of gearing.

The activation of the motor 16 for setting the brush 9 upwards or downwards and/or the activation of the setting means 23 for moving the folding chopper 1 forwards and backwards takes place in such a manner that the sheet products striking the abutment 5 are not damaged and do not recoil from the abutment. In order to ensure that this is so the elastic deflection of the sheet metal member (which forms the abutment 5 and which is held in place by having its top edge clamped in place) on the impact of each product the deflection is detected by a sensing means 24 and the signal representing such deflection is supplied to a regulating circuit for regulation of the braking action or force exerted on the sheet products. The sensing means is formed by a position detector with a sensing pin 25 engaging the back side of the abutment 5 and able to be slid by the elastic deflection of the sheet metal member forming abutment 5.

The signal output of the sensing means 24 is connected with one input of a regulator 26. The other input of the regulator 26 is connected with a set point generator 27. The latter is provided with a setting knob 28 which makes possible a preset of the desired braking action with the aid of the regulator 26 the motor 16 and/or the setting means 23 are operated. The wires for conducting the signals are indicated in the drawing by broken lines. The above described regulating circuit ensures that the setting of the braking device or devices is so corrected during operation that the impact energy is kept within a limit as set by the set point generator 27.

It is frequently sufficient if the abutment 5, whose motion may be detected by the sensing pin 25 is in the form of a sheet metal member arranged adjacent to an edge and which is deflected by the impact of each product to be slowed down in the manner of a strip spring. As an alternative to this arrangement or in addition thereto it is possible for the abutment 5 to have a spring device 29 arranged to the back of it adjacent to where it is attached, this leading to a particularly large overall deflection in the case of the use of a sheet metal member able to be deflected.

I claim:

1. A device for halting sheet products conveyed by a conveyor belt defining a conveying plane, comprising an abutment having said conveyor belt extending therethrough, an adjustable braking means arranged before said abutment in the direction of motion of said belt, said braking means being in the form of brush fitted with means for raising and lowering said brush in relation to said conveying plane, a table placed under said brush, a sensing means for sensing the force of the impact of such products on the abutment, and means for resetting the brush in accordance with an output signal of such sensing means.

2. The device as claimed in claim 1 wherein said abutment is arranged to be resiliently detected by the impact of such products and wherein the sensing means is in the form of a position detecting means.

3. The device as claimed in claim 2 wherein the abutment is in the form of a sheet metal spring member clamped in position at a point adjacent to and edge parallel to said table at one end thereof.

4. The device as claimed in claim 2 comprising a spring arrangement for supporting said abutment.

5. The device as claimed in claim 2 wherein said sensing means comprises a sensing pin engaging the abutment and adapted to be moved in translation thereby.

6. The device as claimed in claim 1 comprising an adjustable set point generator and a regulator having an input connected with an output of said sensing means and a further input connected with said set point generator, and a resetting means connected with an output of the regulator for control thereby and for correction of the position of the braking means.

7. The device as claimed in claim 6 comprising a sliding carriage on which said brush is mounted and reversible motor for moving said carriage and arranged to be activated by said regulator.

8. The device as claimed in claim 1 comprising a folding chopper and a drive therefor, said chopper being adapted to be reciprocated in a vertical direction in synchronism with such sheet products arriving thereat.

9. The device as claimed in claim 8 wherein said regulator is adapted to cause said drive of said chopper to move said chopper backwards and forwards in the direction of driving.

* * * * *